US005249522A

United States Patent [19]

Kusch et al.

[11] Patent Number: 5,249,522

[45] Date of Patent: Oct. 5, 1993

[54] DEVICE FOR ADJUSTING THE CIRCUMFERENTIAL REGISTER AT ROTARY PRINTING MACHINES

[75] Inventors: Hans-Jürgen Kusch, Neckargemünd; Edgar Grundke, Mannheim, both of Fed. Rep. of Germany

[73] Assignee: Heidelberger Druckmachinen Aktiengesellschaft, Heidelberg, Fed. Rep. of Germany

[21] Appl. No.: 966,292

[22] Filed: Oct. 26, 1992

[30] Foreign Application Priority Data

Oct. 30, 1991 [DE] Fed. Rep. of Germany ... 9113505[U]

[51] Int. Cl.[5] ..... B41F 13/14; F41L 35/06

[52] U.S. Cl. ..... 101/248

[58] Field of Search ..... 101/248, 181; 74/395, 74/397, 400; 464/19

[56] References Cited

U.S. PATENT DOCUMENTS 2,425,914 8/1947 Blackley et al. ..... 101/248
3,742,850 7/1973 Sedlak ..... 101/248
3,750,568 8/1973 Weisgerber ..... 101/248

FOREIGN PATENT DOCUMENTS 415380 6/1925 Fed. Rep. of Germany .
1077231 3/1960 Fed. Rep. of Germany .

*Primary Examiner*—J. Reed Fisher
*Attorney, Agent, or Firm*—Nils H. Ljungman & Associates

[57] ABSTRACT

A device for adjusting the circumferential register at rotary printing machines. At least one pulley engaging in a groove of a grooved cam is fastened to the gearwheel. Via tappets, the grooved cam is guided at the cylinder body so as to be axially displaceable. The groove is obliquely disposed as seen axially, and the grooved cam is axially movable via an adjusting means. A simple adjustment of the circumferential register is permitted, and such adjustment can be effected with great accuracy during machine operation. The drive forces caused by the gearwheel may be transmitted onto the cylinder body largely without play.

20 Claims, 3 Drawing Sheets

DEVICE FOR ADJUSTING THE CIRCUMFERENTIAL REGISTER AT ROTARY PRINTING MACHINES

BACKGROUND OF THE INVENTION

1. Field of the Invention:

The invention relates to a device for adjusting the circumferential register at a rotary printing machine, wherein the rotary printing machine comprises a cylinder driven by a gearwheel. The cylinder and the gearwheel are mounted so as to be adjustable with respect to each other. Further, the rotary printing machine comprises means for adjusting the gearwheel with respect to the cylinder body.

2. Background Information:

The production of in-register prints of individual colors on multi-color printing machines usually requires the possibility of, inter alia, adjusting the circumferential register of one cylinder from among a number of cylinders involved in the printing process. It is expedient to effect this adjustment both while the machine is in operation and while the machine is at a standstill. German Patent No. 415 380 discloses an embodiment of such an adjusting device, by means of which the cylinder body can be adjusted in its circumferential direction. For the purpose of adjusting the cylinder via a driving mechanism and an obliquely disposed groove, the embodiment disclosed includes an adjusting means through which the cylinder shaft is axially displaced. A disadvantage of this known embodiment may be found in that, due to the axial displacing of the shaft of the cylinder, the driving gear provided outside the side frame essentially has to be straight-toothed in order to avoid an unwanted adjustment of the cylinder.

In a further known embodiment, disclosed in German Patent No. 10 77 231, a driving gear of a cylinder is adjusted via an eccentric bolt which, in turn, is controlled via levers in connection with further adjusting means. The construction shown tends to require great technical effort.

OBJECT OF THE INVENTION

Proceeding from the known devices just described, it is an object of the present invention to provide a circumferential register adjustment requiring little technical effort and ensuring a very high degree of reliability and accuracy.

SUMMARY OF THE INVENTION

According to the invention, the above and other objects are achieved by a device having: at least one pulley, or roller, for engaging in a groove of a grooved cam, being fastened to a gearwheel; the grooved cam being guided at the cylinder body via tappets so as to be axially displaceable; the groove being obliquely disposed as seen in an axial direction; and the grooved cam being axially movable via an adjusting means. The solution just outlined permits a simple adjustment of the circumferential register and can be effected with great accuracy during machine operation. The drive forces caused by the gearwheel may be transmitted onto the cylinder body largely without play.

Advantageous embodiments of the present invention, which permit an adjustment of the circumferential register programmed in advance, are also disclosed hereinbelow.

In summary, one aspect of the invention resides broadly in apparatus for adjusting circumferential register of a rotary printing machine, the rotary printing machine comprising: a frame; a cylinder being rotatably mounted, about a longitudinal axis thereof, on the frame, the longitudinal axis defining a longitudinal direction of the cylinder; gearwheel means, being rotatably mounted on the frame, for transferring a driving force to the cylinder, the gearwheel means and the cylinder being relatively positionable with respect to one another; means for adjusting the relative position of the gearwheel means and the cylinder with respect to one another; the apparatus comprising: extension means for extending from and being connected to the gearwheel means; disc means being rotatably mounted on the frame; the disc means comprising a groove for accommodating the extension means, the extension means being engageable with at least one surface of the groove for relative displacement with respect to the at least one surface of the groove; the disc means being mounted for displacement in the longitudinal direction of the cylinder; rod means, extending between the disc means and the cylinder, for guiding longitudinal displacement of the disc means with respect to the cylinder; and the groove being oriented obliquely with respect to the longitudinal axis of the cylinder and being configured for adjusting circumferential register of the rotary printing machine in response to the longitudinal displacement of the disc means.

Another aspect of the invention resides broadly in apparatus for adjusting circumferential register of a rotary printing machine, the rotary printing machine comprising: a frame; a cylinder being rotatably mounted, about a longitudinal axis thereof, on the frame, the longitudinal axis defining a longitudinal direction of the cylinder, and the cylinder defining a circumferential direction thereof, in a direction of rotation of the cylinder; gearwheel means, being rotatably mounted on the frame, for transferring a driving force to the cylinder, the gearwheel means and the cylinder being relatively positionable with respect to one another; means for adjusting the relative position of the gearwheel means and the cylinder with respect to one another; the apparatus comprising: extension means and groove means for accommodating the extension means, the groove means comprising a groove; the extension means being engageable with at least one surface of the groove for relative displacement with respect to the at least one surface of the groove; one of the extension means and the groove means being mounted for displacement in the longitudinal direction of the cylinder; rod means for guiding longitudinal displacement, with respect to the cylinder, of the longitudinally displaceable one of the extension means and the groove means; the longitudinally displaceable one of the extension means and the groove means also being configured for displacing the cylinder in the circumferential direction of the cylinder; the groove being oriented obliquely with respect to the longitudinal axis of the cylinder and being configured for adjusting circumferential register of the rotary printing machine in response to the longitudinal displacement of the longitudinally displaceable one of the extension means and the groove means; and the longitudinally displaceable one of the extension means and the groove means being connected to circumferentially displace the cylinder in response to the longitudinal displacement of the longitudinally displaceable one of the extension means and the groove means.

BRIEF DESCRIPTION OF THE DRAWINGS

A specimen embodiment of the present invention is schematically illustrated in the accompanying drawings, wherein.

DESCRIPTION OF THE PREFERRED EMBODIMENTS

Figure 1:
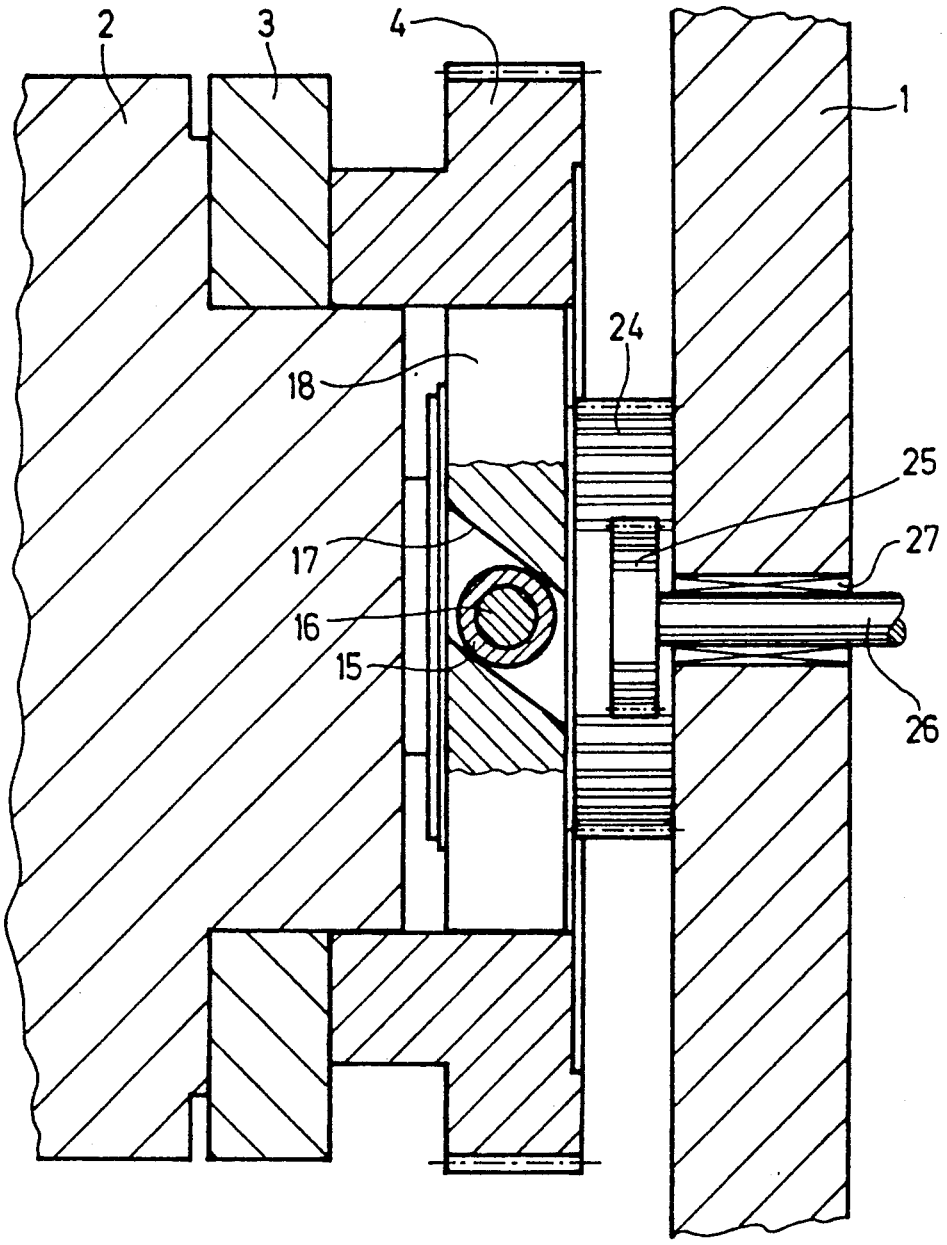
FIG. 1 is a partial longitudinal section through the adjusting device, taken along line I—I of FIG. 3.

A cylinder body 2 which, for example, may be a plate cylinder or an impression cylinder, is mounted between two side frames 1. In the specimen embodiment shown, the cylinder body can carry, on both sides thereof, a bearer ring 3 for rolling off a the bearer ring of an adjacent cylinder (not shown) cooperating with the cylinder body 2. Furthermore, a gearwheel 4, by means of which the cylinder body 2 is driven, can be provided at the front end of the cylinder body 2.

Via shoulder screws 5, the gearwheel 4 can be fastened to the bearer ring 3 and, thus, to the cylinder body 2. The shoulder screws 5 preferably enable a limited adjustment of the cylinder body 2 with respect to the gearwheel 4 in the area of slits 6. The bearer ring 3 is preferably fixedly connected to the cylinder body 2.

Figure 3:
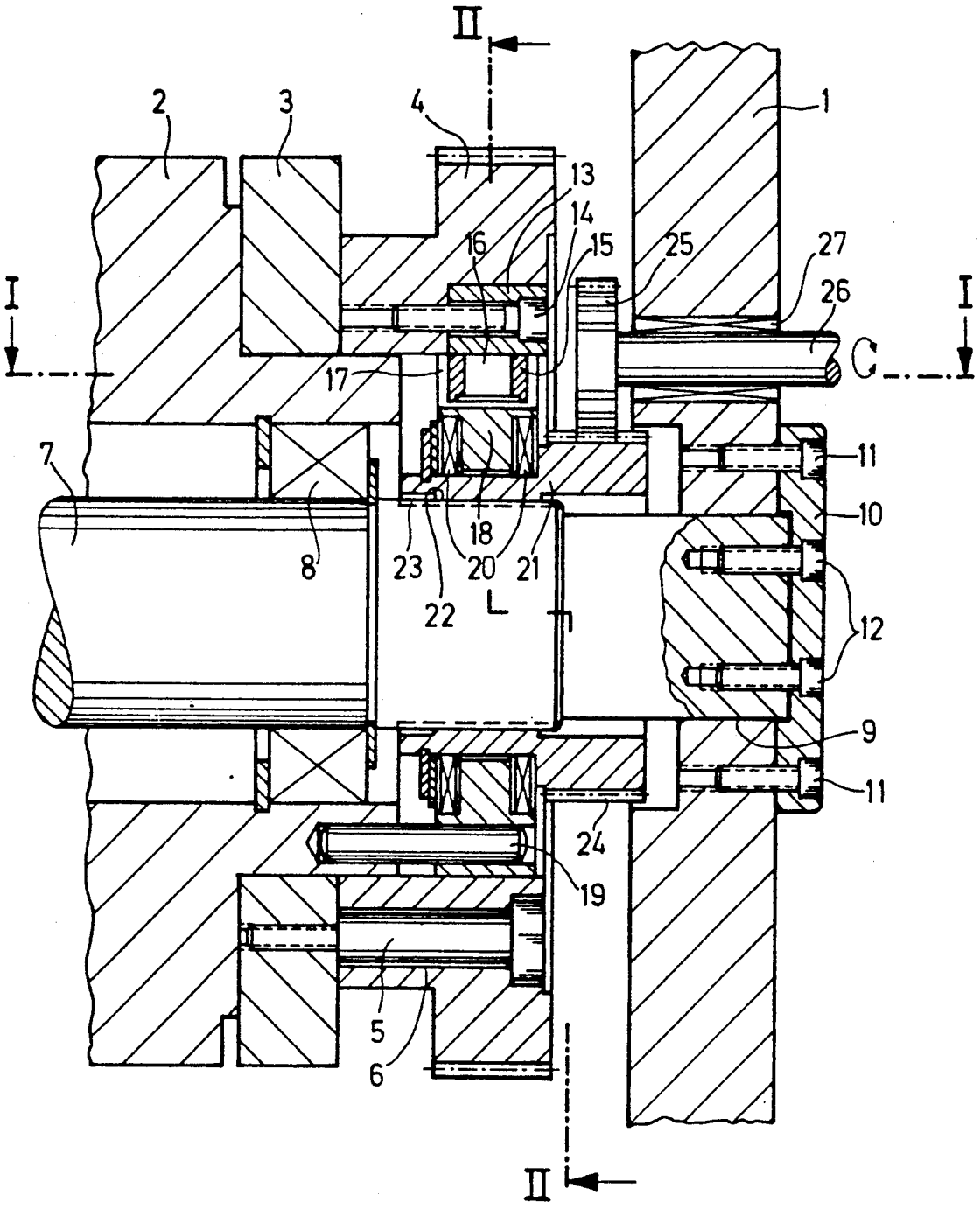
FIG. 3 is a partial longitudinal section through the adjusting device, but offset by 90 degrees as compared to FIG. 1.

As can be seen in FIG. 3, the cylinder body 2 is preferably mounted on an axle 7 via a roller bearing 8. Via a bore 9 in the side frame 1, the axle 7 can be mounted in the side frame 1 and can be held in place by a lid 10 which can be fastened to the side frame 1 via screws 11 and to the axle 7 via further screws 12.

Preferably, via a bearing body 13, fixed in the gearwheel 4 by means of screws 14, a pulley, or roller, 15 is mounted on a pin 16 of the bearing body 13. The pulley 15 preferably engages in a groove 17 of a grooved cam 18 which, in turn, is disposed in the gearwheel 4 and is guided at the cylinder body 2 so as to be axially displaceable by means of tappets 19, as shown in FIGS. 2 and 3. The drive forces acting on the gearwheel 4 are thus transmitted, via the pulley 15, onto the grooved cam 18 from where they are transmitted onto the cylinder body 2 via the tappets 19. Seen axially in FIG. 1, the groove 17 is preferably obliquely disposed in the grooved cam 18.

The grooved cam 18 can be limited, or bound, on both sides thereof, by thrust bearings 20 axially mounted in a respective threaded bushing 21. The threaded bushing 21 preferably has an internal thread 22 for engaging in a thread 23 provided on the axle 7. By adjusting the threaded bushing 21, the threaded bushing 21 can be axially displaced via the threads 22, 23 and can move the grooved cam 18 back and forth in an axial direction via the two thrust bearings 20. Thus, the cylinder body 2 can be adjusted with respect to the gearwheel 4 by means of the oblique groove 17 and the engaging pulley 15. After the gearwheel 4 has engaged in the gearwheel of the neighboring cylinder, it is possible, via the adjusting means, to adjust the cylinder body 2 with respect to the neighboring cylinder in view of a circumferential register adjustment.

The threaded bushing 21 features a lateral toothing 24 in which an adjusting wheel 25 engages. With its journal 26, the adjusting wheel 25 can be adjustably mounted in the side frame 1 via a bearing 27. The journal 26 may, for example, be connected to a motor (not illustrated), which may incorporate remote control, or to a handwheel for manual adjustment. For effecting an adjustment of the circumferential register, the threaded bushing 21 may be adjusted via the journal 26 and the adjusting wheel 25, even while the machine is running. This guarantees a very sensitive adjustment of the circumferential register.

The disclosure now turns to an even more detailed description of a preferred embodiment of the present invention, with reference to the accompanying drawings.

Figure 2:
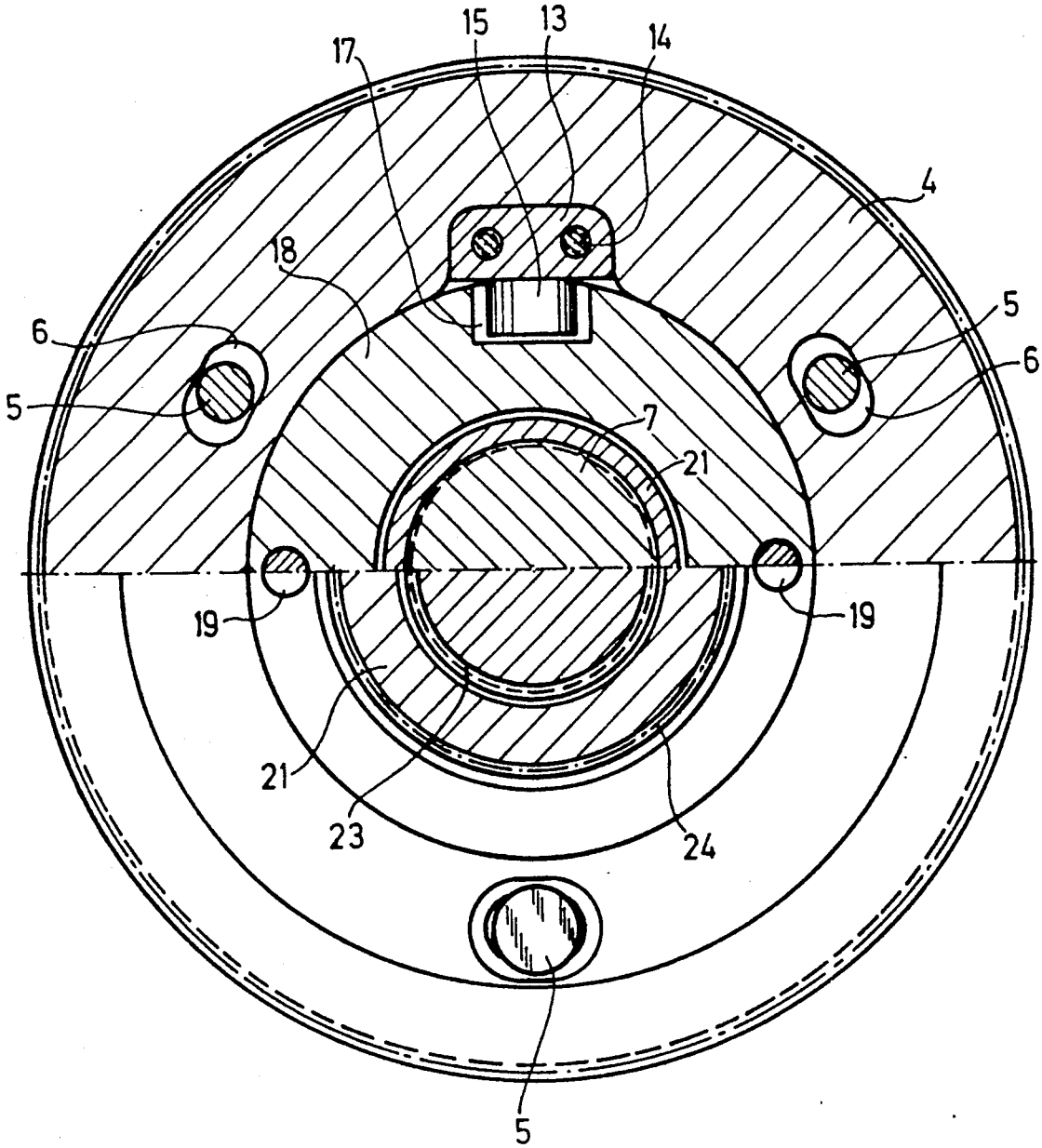
FIG. 2 is a partial cross-section through the adjusting device, taken along line II—II of FIG. 3.

As shown in FIG. 1, a side frame 1 of a rotary printing machine is configured for supporting a cylinder, which cylinder may be, for example, a plate cylinder, impression cylinder, or other cylinder. The cylinder includes a cylinder body 2 and preferably includes, towards either end of the cylinder, a bearer ring, or bearing ring 3. Bearing ring 3 can generally be configured for engaging with a similar bearing ring of a neighboring cylinder and is preferably fixedly connected to cylinder body 2.

As shown, a gearwheel 4 is generally provided at an extreme end of cylinder body 2 to transmit a driving force to the cylinder body 2. The gearwheel 4 itself is driven by means well-known to those of ordinary skill in the art.

In a manner which will be more apparent from FIGS. 2 and 3, a pin 16 is preferably mounted on gearwheel 4 and extends radially, towards a central longitudinal axis of rotation of cylinder body 2 and gearwheel 4. Preferably rotatably mounted on pin 16 is a pulley or roller 15.

A grooved cam, or grooved cam disc, 18 is preferably rotatably mounted about axle 7 and is preferably surrounded by gearwheel 4. Preferably disposed in grooved cam disc 18 is a groove 17. Groove 17 is preferably disposed diagonally, or at a slant, with respect to the longitudinal rotational axis of gearwheel 4, cylinder body 2 and grooved cam disc 18, that is, the axis of rotation running parallel to axle 7. Also, as shown, roller 15, extending radially inwardly from an inward-facing surface of gearwheel 4, is preferably configured to engage, preferably rollingly, with inner surfaces of groove 17, which surfaces essentially extend in a radial direction with respect to grooved cam disc 18. It should be understood that the preferred embodiments of the present invention are not necessarily limited to the use of a roller, per se, within the groove 17, but may also, alternatively, encompass the use of a pin or other non-rotating component, wherein such a component would be configured to slidingly, rather than rotatingly, engage with inner surfaces of groove 17.

The gearwheel 4 is preferably fastened to the bearing ring 3 and, thus, effectively, to the cylinder body 2, by means of shoulder screws 5. As shown in FIG. 2, shoulder screws 5 can be mounted within slits 6 so as to enable a limited circumferential adjustment of the cylinder body 2 with respect to gearwheel 4.

Also, the slits 6, which may be alternatively termed recesses, grooves or indentations, are preferably of such a size that a head of shoulder screw 5 can be completely accommodated therewithin. Further, each slit 6 is preferably configured such that a shoulder screw 5 can be slidably displaced therewithin, essentially in a generally circumferential direction of gearwheel 4. Thus, each slit 6 may essentially serve to effectively guide and limit a circumferential positioning of cylinder body 2 and gearwheel 4 with respect to each other.

Gearwheel 4 preferably includes a bearing body 13 mounted thereupon for carrying pin 16 and, accordingly, roller 15. As shown, bearing body 13 is preferably fixedly connected to gearwheel 4 and is preferably disposed so as not to protrude significantly inwardly of the inward-facing surfaces of gearwheel 4. Pin 16, and roller 15, accordingly extend towards axle 7 and, thus, inwardly of the inward-facing surfaces of gearwheel 4.

FIG. 3 more particularly illustrates the various components employed in a preferred embodiment of the present invention. Cylinder body 2 is preferably mounted on an axle 7 by means of a roller bearing 8 disposed about the axle 7. The axle 7 is preferably mounted in side frame 1 by means of a bore 9 passing through side frame 1. Preferably covering an end of the axle 7 disposed through bore 9, and overlapping that end of axle 7, is a lid 10. Preferably, lid 10 is secured to the frame 1 by means of screws 11 and to an extreme end of axle 7 by means of screws 12.

Preferably, disposed about the axle 7 is a threaded bushing 21. Threaded bushing 21 preferably has an internal thread 22 for engagement with a thread 23 on the axle. Preferably mounted on the threaded bushing 21 are thrust bearings 20. As shown, the grooved cam disc 18 is preferably bordered, on both sides thereof, by the thrust bearings 20.

The threaded bushing 21, towards an end thereof, between grooved cam disc 18 and frame 1, is preferably provided with a lateral toothing 24. An adjusting wheel 25 is preferably engageable with the lateral toothing, which adjusting wheel is preferably rotatable means of a journal 26, in turn connected to an adjusting device, such as a motor or a handwheel. In this manner, journal 26 and adjusting wheel 25 are thus configured for rotating threaded bushing 21 such that threaded bushing 21 can be displaced longitudinally in response to the operation of the adjusting device.

Operational driving of cylinder body 2 is preferably accomplished by rotation of gearwheel 4. The driving force provided by gearwheel 4 is preferably transferred to grooved cam disc 18 by means of pin 16 and roller 15 engaging in slot 17. In other words, as can readily be appreciated from the drawings, the rotational driving force provided by gearwheel 4 causes the roller 15 to travel therewith and to transmit the driving force to an inner surface of slot 17 of grooved cam disc 18, whereby rotation of grooved cam disc 18 is thence effected.

The driving force which has been transferred from gearwheel 4 to grooved cam disc 18 is thence transferred, through the medium of tappets 19, to cylinder body 2 to cause cylinder body 2 to rotate about axle 7.

In order to adjust circumferential register of cylinder body 2, whether or not during operation of the rotary printing machine, the aforementioned adjusting device (not shown) may be activated to rotate journal 26. The rotation of journal 26 thence rotates adjusting wheel 25 and, accordingly, threaded bushing 21. At this stage, threaded bushing 21 is essentially displaced longitudinally, along axle 7. Thence, via the two thrust bearings 20, longitudinal, or axial, displacement of grooved cam disc 18, relative to cylinder body 2, takes place. It will be appreciated that such longitudinal displacement of grooved cam disc 18 is afforded by tappets 19, which tappets preferably extend longitudinally between cylinder body 2 and grooved cam disc 18, and which are preferably configured to render grooved cam disc 18 slidably displaceable, in the longitudinal direction, with respect to cylinder body 2.

Preferably, as a consequence of the slanted configuration of groove 17, groove 17 and roller 15 interact in such a way that the longitudinal displacement of grooved cam disc 18 also results in a further circumferential displacement of grooved cam disc 18. Because tappets 19 preferably extend longitudinally to connect grooved cam disc 18 with cylinder body 2 and thus are preferably essentially configured for transmitting any circumferential driving force from grooved cam disc 18 to cylinder body 2, this induced circumferential displacement of grooved cam disc 18 also essentially causes cylinder body 2 also to undergo a further displacement in the circumferential direction, to thus effect adjustment of circumferential register.

One feature of the invention resides broadly in a device for adjusting the circumferential register at a rotary printing machine, comprising a cylinder driven by a gearwheel, the cylinder and the gearwheel being mounted so as to be adjustable with respect to each other, and comprising means for adjusting the cylinder body with respect to the gearwheel, characterized in that at least one pulley 15 engaging in a groove 17 of a grooved cam 18 is fastened to the gearwheel 4, in that, via tappets 19, the grooved cam 18 is guided at the cylinder body 2 so as to be axially displaceable, in that axially seen the groove 17 is obliquely disposed in the grooved cam 18, and in that the grooved cam 18 is axially movable through an adjusting means.

Another feature of the invention resides broadly in a device, characterized in that the adjusting means for axially moving the grooved cam 18 consists of a threaded bushing 21 being mounted on a thread 23 provided on a cylinder axle 7 so as to be adjustable, in that the threaded bushing 21 has a toothing 24 in which an adjusting wheel 25 engages, and in that the grooved cam 18 is connected to the threaded bushing 21 via thrust bearings 20.

Yet another feature of the invention resides broadly in a device, characterized, in that the gearwheel 4 is mounted on the cylinder body 2 via shoulder screws 5 so as to be adjustable in circumferential direction.

Still another feature of the invention resides broadly in a device, characterized in that the adjusting wheel 25 is mounted in the machine side frame 1 and connected to an adjusting motor.

The concept of registration at a rotary printing machine is well-known and discussed, for example, in the following U.S. Patents: U.S. Pat. No. 5,088,409 to Roskosch, entitled "Device for Adjusting a Flexible Printing Plate on a Plate Cylinder of a Rotary Printing Press"; and U.S. Pat. No. 4,785,736 to Jeschke, entitled "Device for Tensioning a Flexible Printing Plate Mounted on a Plate Cylinder".

Examples of rotary printing machines, and components therefor, which may be used in accordance with the embodiments of the present invention, may be found in the U.S. Patents listed immediately above also in U.S. Pat. No. 5,081,926, which issued to Rodi on Jan. 21, 1992.

All, or substantially all, of the components and methods of the various embodiments may be used in any combination with at least one embodiment or all of the embodiments, if any, described herein.

All of the patents, patent applications and publications recited herein, if any, are hereby incorporated by reference as if set forth in their entirety herein.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. Apparatus for adjusting circumferential register of a rotary printing machine, the rotary printing machine comprising: a frame; a cylinder being rotatably mounted, about a longitudinal axis thereof, on the frame, the longitudinal axis defining a longitudinal direction of the cylinder; gearwheel means, being rotatably mounted on the frame, for transferring a driving force to the cylinder, the gearwheel means having at least one radius, the gearwheel means and the cylinder being relatively positionable with respect to one another; means for adjusting the relative position of the gearwheel means and the cylinder with respect to one another; said apparatus comprising:

extension means for extending from and being connected to the gearwheel means;

said extension means having a generally cylindrical shape, the generally cylindrical shape of said extension means having a round cross-sectional shape and a central axis through a center of the round cross-sectional shape, the central axis being disposed along a radius of said gearwheel means;

disc means;

means for rotatably mounting said disc means on the frame;

said disc means comprising a groove for accommodating said extension means, said extension means being engageable with at least one surface of said groove for relative displacement with respect to the at least one surface of said groove;

rod means, extending between said disc means and the cylinder, for guiding longitudinal displacement of said disc means with respect to said cylinder;

said disc means comprising means for accommodating a portion of said rod means such that said disc means is longitudinally displaceable along said rod means; and said groove being oriented obliquely with respect to the longitudinal axis of the cylinder and being configured for adjusting circumferential register of the rotary printing machine in response to the longitudinal displacement of said disc means.

2. The apparatus according to claim 1, the cylinder defining a circumferential direction thereof, in a direction of rotation of the cylinder, wherein:

said disc means comprises means for displacing the cylinder in the circumferential direction of the cylinder.

3. The apparatus according to claim 2, wherein said means for displacing the cylinder in the circumferential direction of the cylinder comprises means for circumferentially displacing the cylinder in response to the longitudinal displacement of said disc means and said groove means.

4. The apparatus according to claim 3, wherein said means for displacing the cylinder in the circumferential direction of the cylinder comprises said rod means.

5. The apparatus according to claim 4, wherein said extension means comprises at least one roller, said at least one roller extending from and being connected with the gearwheel means, said roller being engageable with at least one surface of said groove for relative displacement with respect to the at least one surface of said groove.

6. The apparatus according to claim 5, wherein said extension means further comprises at least one pin, each said at least one roller being rotatably mounted about a corresponding one of said at least one pin, each said at least one pin extending from and being connected to the gearwheel means.

7. The apparatus according to claim 6, wherein the cylinder is mounted about an axle for rotation thereabout, the axle being generally fixed with respect to the frame, said apparatus further comprising:

means for longitudinally displacing said disc means, said longitudinal displacement means comprising bushing means disposed about the axle, said disc means being mounted for rotation about said bushing means;

said bushing means comprising an internal thread, the axle comprising an external thread for being engaged with said internal thread of said bushing means;

said bushing means being longitudinally displaceable by means of the engagement of said internal thread with said external thread; and said bushing means comprising means for longitudinally displacing said disc means in response to the longitudinal displacement of said bushing means.

8. The apparatus according to claim 7, wherein said bushing means comprises thrust bearing means being longitudinally interfaceable with said disc means and providing a rotational bearing therefor, said means for longitudinally displacing said disc means in response to the longitudinal displacement of said bushing means comprising said thrust bearing means.

9. The apparatus according to claim 8, further comprising:

said bushing means comprising an external toothing; and adjusting wheel means for being engaged with said external toothing of said bushing means, said adjusting wheel means being rotatably mounted on the frame and being configured for circumferentially displacing said bushing means by interacting with said external toothing of said bushing means.

10. The apparatus according to claim 9, wherein the rotary printing machine includes means for rotating said adjusting wheel means, the means for rotating said adjusting wheel means comprising a motor, said apparatus further comprising:

shoulder screw means for mounting said gearwheel means on the cylinder, said shoulder screw means comprising means for positionally adjusting said gearwheel means in the circumferential direction, with respect to the cylinder;

said adjusting wheel means being connected to the motor for being rotated by the motor;

said at least one roller consisting of one roller;

said at least one pin consisting of one pin;

said pin extending in a radial direction of said gearwheel means;

said roller being mounted on said pin generally for rotation in a plane generally orthogonal to said pin;

said gearwheel means comprising a gearwheel being generally annular in shape;

said gearwheel having an inward-facing surface at an inner portion of its annular shape;

a bearing body being mounted within said gearwheel and generally flush with the inward-facing surface of said gearwheel, such that said pin originates at and generally extends away from the inward-facing surface of said gearwheel;

slit means being disposed in said gearwheel, said slit means being configured for guiding generally circumferential displacement of said shoulder screw means;

said groove being oriented at an angle of about forty-five degrees with respect to the longitudinal direction of the cylinder;

said groove comprising three surfaces, two of said surfaces being generally parallel and being oriented in a general radial direction of said disc means, the other surface being generally transverse to the two other surfaces and connecting the other two surfaces;

said roller being configured generally for contacting the two parallel surfaces of said groove;

a journal for connecting the motor with said adjusting wheel means; and said journal comprising means for rotating said adjusting wheel means in response to a rotational force provided by the motor.

11. Apparatus for adjusting circumferential register of a rotary printing machine, the rotary printing machine comprising: a frame; a cylinder being rotatably mounted, about a longitudinal axis thereof, on the frame, the longitudinal axis defining a longitudinal direction of the cylinder, the cylinder having at least one radius, and the cylinder defining a circumferential direction thereof, in a direction of rotation of the cylinder; gearwheel means, being rotatably mounted on the frame, for transferring a driving force to the cylinder, the gearwheel means and the cylinder being relatively positionable with respect to one another; means for adjusting the relative position of the gearwheel means and the cylinder with respect to one another; said apparatus comprising:

extension means and groove means for accommodating said extension means, said groove means comprising a groove;

said extension means being engageable with at least one surface of said groove for relative displacement with respect to the at least one surface of said groove;

said extension means having a generally cylindrical shape, the generally cylindrical shape of said extension means having a round cross-sectional shape and a central axis through a center of the round cross-sectional shape, the central axis being disposed in a direction parallel to a radius of the cylinder and perpendicular to the longitudinal axis of the cylinder;

one of said extension means and said groove means being displaceable in the longitudinal direction of the cylinder;

rod means for guiding longitudinal displacement, with respect to said cylinder, of said longitudinally displaceable one of said extension means and said groove means;

said longitudinally displaceable one of said extension means and said groove means comprising means for displacing the cylinder in the circumferential direction of the cylinder;

said groove being oriented obliquely with respect to the longitudinal axis of the cylinder and being configured for adjusting circumferential register of the rotary printing machine in response to the longitudinal displacement of said longitudinally displaceable one of said extension means and said groove means; and said means for displacing the cylinder in the circumferential direction of the cylinder comprising means for circumferentially displacing the cylinder in response to the longitudinal displacement of said longitudinally displaceable one of said extension means and said groove means.

12. The apparatus according to claim 11, further comprising disc means, said disc means comprising said groove means and being rotatably mounted on the frame, said groove being disposed in said disc means.

13. The apparatus according to claim 12, wherein said rod means extend between said disc means and the cylinder.

14. The apparatus according to claim 13, wherein said means for displacing the cylinder in the circumferential direction of the cylinder comprises said rod means.

15. The apparatus according to claim 14, wherein said extension means is for extending from and being connected to said gearwheel means.

16. The apparatus according to claim 15, wherein said extension means comprises at least one roller, said at least one roller extending from and being connected with the gearwheel means, said roller being engageable with at least one surface of said groove for relative displacement with respect to the at least one surface of said groove.

17. The apparatus according to claim 16, wherein said extension means further comprises at least one pin, each said at least one roller being rotatably mounted about a corresponding one of said at least one pin, each said at least one pin extending from and being connected to the gearwheel means.

18. The apparatus according to claim 17, wherein the cylinder is mounted about an axle for rotation thereabout, the axle being generally fixed with respect to the frame, said apparatus further comprising:

means for longitudinally displacing said disc means, said longitudinal displacement means comprising bushing means disposed about the axle, said disc means being mounted for rotation about said bushing means;

said bushing means comprising an internal thread, the axle comprising an external thread for being engaged with said internal thread of said bushing means;

said bushing means being longitudinally displaceable by means of the engagement of said internal thread with said external thread; and said bushing means comprising means for longitudinally displacing said disc means in response to the longitudinal displacement of said bushing means.

19. The apparatus according to claim 18, wherein said bushing means comprises thrust bearing means being longitudinally interfaceable with said disc means and providing a rotational bearing therefor, said means for longitudinally displacing said disc means in response to the longitudinal displacement of said bushing means comprising said thrust bearing means.

20. The apparatus according to claim 19, wherein the rotary printing machine includes means for rotating said adjusting wheel means, the means for rotating said adjusting wheel means comprising a motor, said apparatus further comprising:

said bushing means comprising an external toothing;

adjusting wheel means for being engaged with said external toothing of said bushing means, said adjusting wheel means being rotatably mounted on the frame and being configured for circumferentially displacing said bushing means by interacting with said external toothing of said bushing means;

shoulder screw means for mounting said gearwheel means on the cylinder, said shoulder screw means comprising means for positionally adjusting said gearwheel means in the circumferential direction, with respect to the cylinder;

said adjusting wheel means being connected to the motor for being rotated by the motor;

said at least one roller consisting of one roller;

said at least one pin consisting of one pin;

said pin extending in a radial direction of said gearwheel means;

said roller being mounted on said pin generally for rotation in a plane generally orthogonal to said pin;

said gearwheel means comprising a gearwheel being generally annular in shape;

said gearwheel having an inward-facing surface at an inner portion of its annular shape;

a bearing body being mounted within said gearwheel and generally flush with the inward-facing surface of said gearwheel, such that said pin originates at and generally extends away from the inward-facing surface of said gearwheel;

slit means being disposed in said gearwheel, said slit means being configured for guiding generally circumferential displacement of said shoulder screw means;

said groove being oriented at an angle of about forty-five degrees with respect to the longitudinal direction of the cylinder;

said groove comprising three surfaces, two of said surfaces being generally parallel and being oriented in a general radial direction of said disc means, the other surface being generally transverse to the two other surfaces and connecting the other two surfaces;

said roller being configured generally for contacting the two parallel surfaces of said groove;

a journal for connecting the motor with said adjusting wheel means; and said journal comprising means for rotating said adjusting wheel means in response to a rotational force provided by the motor.

* * * * *